US005727696A

United States Patent [19]

Valiulis

[11] Patent Number: 5,727,696

[45] Date of Patent: Mar. 17, 1998

[54] BUSINESS CARD DISPLAY HOLDER

[75] Inventor: Stanley C. Valiulis, Rockford, Ill.

[73] Assignee: Southern Imperial, Inc., Rockford, Ill.

[21] Appl. No.: 703,492

[22] Filed: Aug. 27, 1996

[51] Int. Cl.[6] ..... B42F 9/00

[52] U.S. Cl. ..... 211/51; 40/737; D6/314

[58] Field of Search ..... 211/50, 51, 43; 40/737; D6/314, 449; D19/90; 312/190

[56] References Cited

U.S. PATENT DOCUMENTS

| | | | |
|---|---|---|---|
| D. 141,059 | 5/1945 | Seigel | D6/314 |
| D. 162,153 | 2/1951 | Gilfert | D19/90 |
| D. 220,911 | 6/1971 | McGrady | D6/314 |
| D. 311,457 | 10/1990 | Shapiro | D6/314 |
| 2,125,320 | 8/1938 | Segar | 312/190 |
| 2,769,550 | 11/1956 | Rollins et al. | 211/50 |
| 3,086,658 | 4/1963 | Palmer | 211/50 |
| 4,242,817 | 1/1981 | Ballard | 40/737 |
| 4,588,093 | 5/1986 | Feild | 211/51 |

*Primary Examiner*—Peter M. Cuomo
*Assistant Examiner*—Gerald A. Anderson
*Attorney, Agent, or Firm*—Leydig, Voit & Mayer, Ltd.

[57] ABSTRACT

A display holder, which conveniently presents a supply of business cards for individual distribution, is formed of a unitary extrusion of transparent semi-rigid thermoplastic material. The extrusion defines a channel having open sides and an open top, and a bottom for supporting the business cards. A resilient finger, also extruded with the channel, is attached to the back and has a card-supporting edge sprung toward the front which forms a display face. The finger is attached to the back with a connection sufficiently resilient to allow insertion of a full stack of business cards in the holder, while retaining sufficient flexibility to continue to bias the cards against the face of the holder, even when the supply of cards is depleted to as few as one.

12 Claims, 3 Drawing Sheets

BUSINESS CARD DISPLAY HOLDER

FIELD OF THE INVENTION

This invention relates to displays, such as those used for merchandising, and more particularly to a display element which presents a stack of business cards for display and distribution.

BACKGROUND OF THE INVENTION

A significant use of displays embodying the invention is in conjunction with displays containing commercial literature for distribution to the public. For example, at trade shows, product displays often include a holder or small bin containing brochures or flyers describing the product and its features. It is often desirable to associate a supply of business cards with the display, so that a user can take the literature and the card or either, as he chooses. Even in the case where the literature has printed information or stamped information indicating a suggested sales representative, it is usually desirable to also display and allow the user to take a business card to enhance the likelihood that the user will ultimately follow up with the supplier.

The trade literature is usually displayed in bins or holders which keep the literature in reasonable order so as to enhance the esthetics of the display. Typically, the literature is more than a single page, and will ordinarily have a spine which will help to support the literature. The bin or holder will be configured and angled to take advantage of whatever self-supporting characteristics the literature may have, to present a neat and orderly appearance.

When business cards are displayed with literature, they can often diminish the attractiveness of the display, because the card holder does not present the cards as neatly as does the literature holder. If the business cards are put in a trough, even if the face of the trough is transparent, after the stack of cards is partially depleted, the information on the face of the top business card will be difficult to read without first taking a card. If a card is taken and replaced with less than the desired amount of care, further problems can result.

Particularly in situations where it is desired to display the information on the business card so that it is readily seen by an observer along with the trade literature, the options from available display devices are not altogether satisfactory.

SUMMARY OF THE INVENTION

In view of the foregoing, it is a general aim of the present invention to provide a display holder for business cards which has a transparent face for showing the information on the business card, and which maintains the top card in a display position irrespective of the size of the stack of business cards in the display holder.

It is an object to accomplish that aim in an expensive and straightforward manner, without the need for manually adjustable elements.

An object of the invention is to provide a business card display holder which can be readily re-filled, depleted during use, and which will always, until emptied, maintain the top business card both ready for selection and presented to a user for easy viewing.

In that respect, an object of the present invention is to form such a display holder from a readily extrudable thermoplastic material having an integral channel and support means for taking advantage of the partly self-supporting character of a business card, to maintain business cards in a display position ready for selection with a top card both ready for selection and maintained in display position irrespective of the number of cards in the holder at any given time.

Other objects and advantages will become apparent upon reference to the detailed description when taken in conjunction with the drawings in which:

Figure 1:
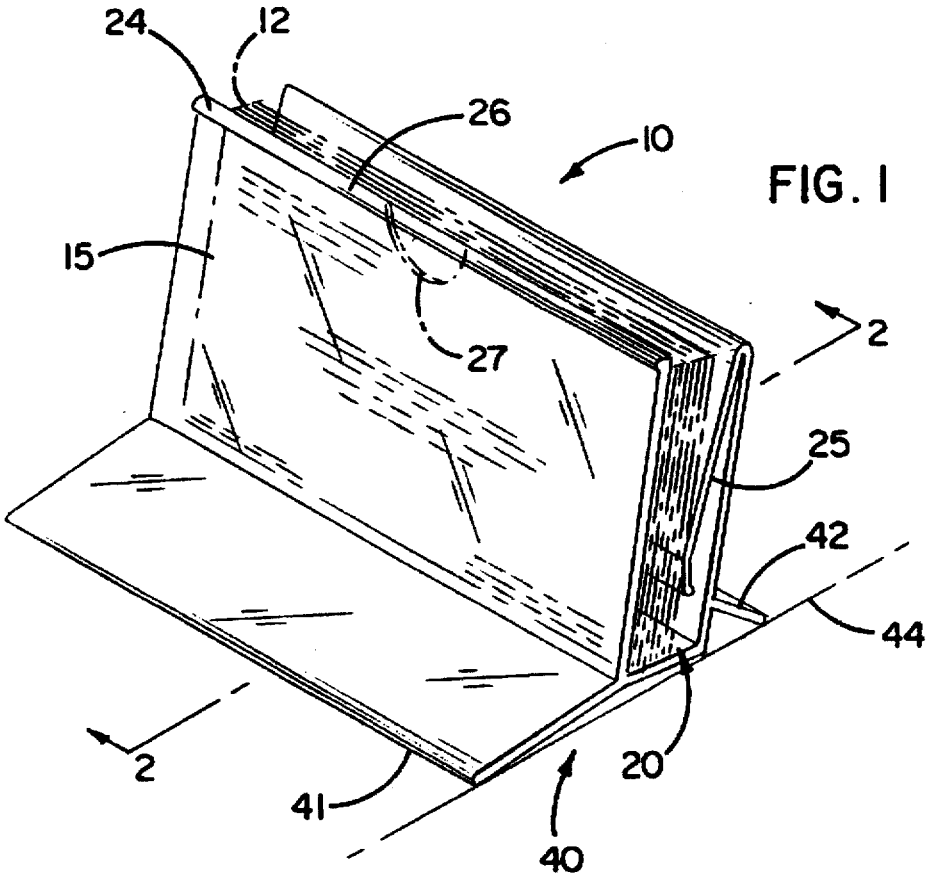
FIG. 1 is a perspective view showing a first embodiment of a display card holder constructed in accordance with the present invention.

While the invention will be shown in connection with certain preferred embodiments, there is no intent to limit it to those embodiments. On the contrary, the intent is to cover all alternatives, modifications and equivalents included within the spirit and scope of the invention as defined by the appended claims.

DETAILED DESCRIPTION OF THE PREFERRED EMBODIMENTS

For purposes of illustration, the invention has been shown in the drawings as embodied in a business card display holder 10 which is adapted to display a stack of business cards in an orderly fashion and allow the cards to be withdrawn one at a time, while still maintaining the orderliness of the display. In particular, it will be seen in FIGS. 1 and 2 that the holder 10 suitably supports a relatively large stack 12 of business cards, maintaining a first card 14, at the top of the stack, securely pressed against a display face 15 of the business card holder. FIG. 3 then illustrates the supply of cards 12 being depleted to a single card 13, which continues to be held securely against the display face 15. The supply of business cards can be refilled any time between the condition of FIG. 2 and FIG. 3, and until the last business card is removed, it continues to present the stack of business cards in an orderly fashion with the front card pressed against the display face where it is readily observable and readable by a user.

Figure 2:
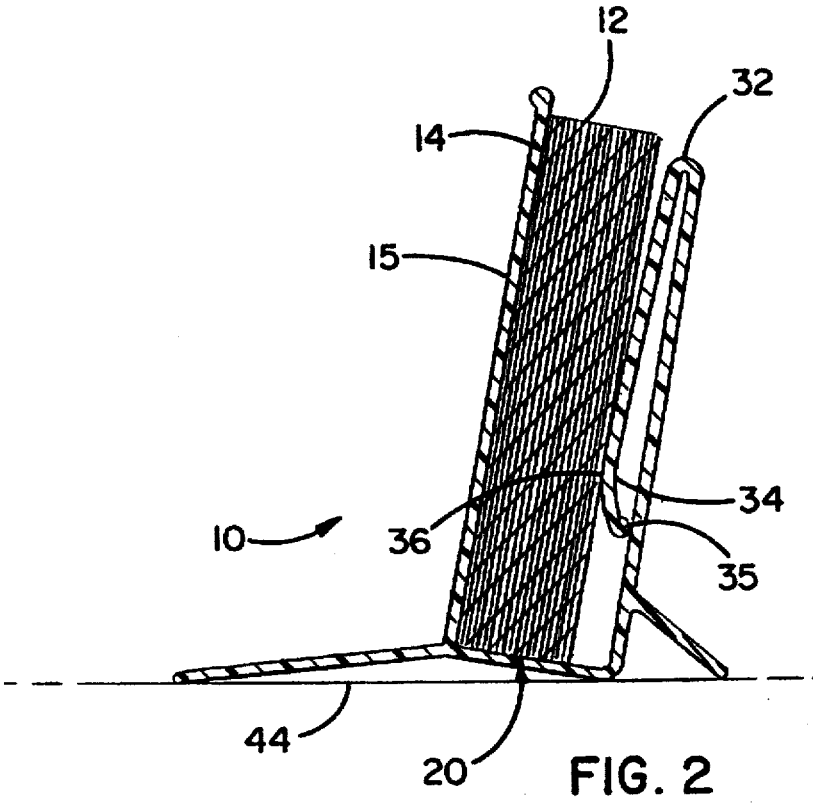
FIG. 2 is a sectional view taken generally along the line 2—2 of FIG. 1 showing the display holder containing a full stack of business cards.
Figure 3:
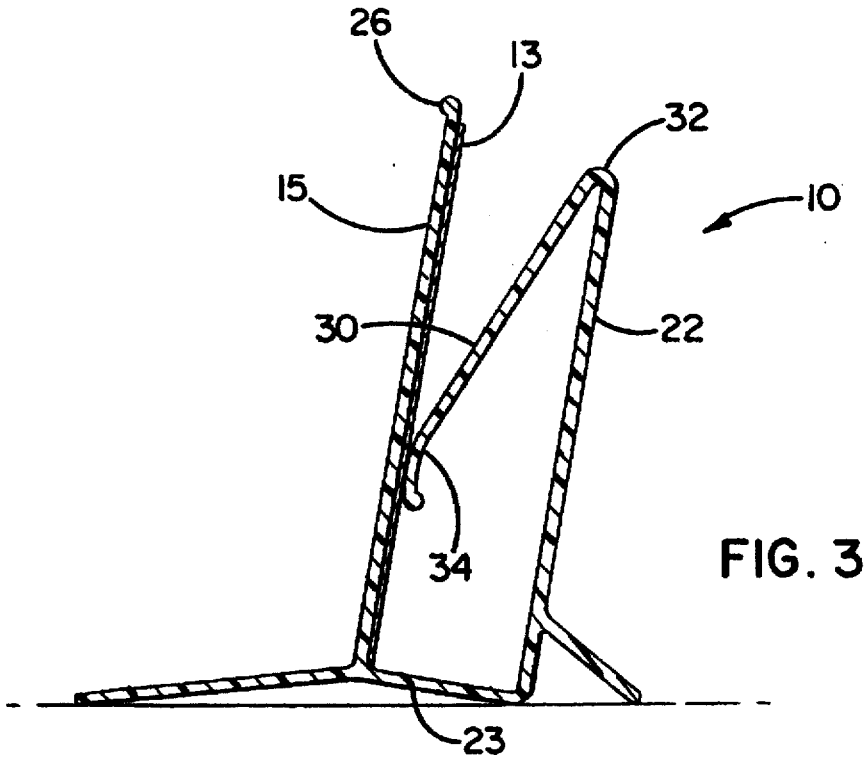
FIG. 3 is a drawing like FIG. 2 but showing the stack of business cards depleted to a single card.

Turning in greater detail to the structure of the invention, it will be seen from FIGS. 2 and 3 that the display holder is based on a channel member 20 which is preferably an extruded channel of semi-rigid thermoplastic material. In order to allow reading of the card through the display face, the plastic material is desirably transparent. The channel member 20 presents a cross section (see for example, FIG. 3) which has a display face 15, a back 22 and a bottom 23. As shown in FIG. 1, the channel has sides 24, 25 which are open, as is the top 26. A bead 26 is formed at the upper edge of the display face to provide a finished surface both for appearance and touch. If desired, a finger notch 27 (shown in dashed lines in FIG. 1) can be cut out of the display face.

In practicing the invention, a unitary extruded elongate finger 30 is attached to the channel back 22 as by a hinge 32. The hinge 32 has sufficient flexibility to allow insertion of a full stack 12 of business cards (see FIG. 2) and sufficient resilience to continue to bias the front card 14 against the display face 15, even when the supply 12 is depleted to a single card 13 as shown in FIG. 3. The hinge 32 is of sufficient resilience to allow many cycles of operation for insertion of stacks of cards and withdrawal of cards either singly or in small groups.

The resilience is provided in part by appropriate selection of the thermoplastic material, by providing a suitable shape for the hinge 32, and sufficient material in the hinge to prevent premature failure. It is particularly important that the thermoplastic material be semi-rigid; in other words, it should have enough flexibility to allow the hinge to flex and cards to be inserted and removed without premature failure. Suitable semi-rigid plastic materials include a wide range of clear acrylics, butyrate and PVC.

In the preferred embodiment, the lower portion of the finger 30 has a rearwardly curved section 34 terminating in a stop member 35 which engages the rear wall when a full stack 12 of business cards is inserted. Inserting additional cards will require the flexure of a further hinge point 35 before imposing significant additional forces on the hinge 32. Thus, the built-in overfilling prevention mechanism at the lower portion of the spring finger 30 provides the business card holder with an additional measure of ruggedness. The radius 36 at the outside portion of the recurved section 34 provides a contoured surface to bias against the rearmost card in the stack as the stack is depleted from the full stack condition of FIG. 2 to the nearly empty condition of FIG. 3. It will be seen that the point of contact between the spring bias finger 30 and the card changes as the spring finger travels forward to resiliently bias the ever-decreasing supply of cards against the display face 15.

FIGS. 1–3 show a first embodiment of the invention which is adapted for placement on a horizontal surface such as a table, a machine or the like. The support is illustrated in the form of foot means 40 which has a first member 41 extending forwardly of the channel 20 and a second member 42 extending rearwardly of the channel. The feet 41, 42 are preferably extruded with the channel member 20 and are attached near the bottom thereof to extend into a horizontal plane generally indicated at 44. Thus, the integrally extruded feet are adapted for supporting the business card holder on a surface as illustrated by the horizontal line 44, and are of sufficient width to reliably support the display holder on this horizontal surface. This slight upward inclination of the display face 15 achieved by the foot arrangement of FIGS. 2 and 3 can be adjusted by appropriately altering the extrusion die.

The business card holder as shown in FIGS. 1–3 is preferably formed by extrusion. In a unitary extrusion process the channel, finger, hinge and supporting feet or other support means, are all formed in a single extrusion process, with the shape of those elements being controlled by the shape of the extrusion die, as will be appreciated by those skilled in this art. The extrusion process produces a long strip, having a cross section of FIG. 3 (cards removed, of course) and an extended length controlled by the extrusion process. After extrusion and cooling, the extruded length is segmented into individual business card size lengths. In one preferred form of the invention, the lengths, and therefore the length of the display face, is between 3" and 4", preferably 3½", and the height of the display face is about 2". The channel is at least ½" in width, and that should provide capacity for holding at least 50 business cards of normal, generically self-supporting, business card stock. In situations where business cards are a different size, for example, in Europe, or where cards of non-standard size are displayed, the dimensions can be adjusted accordingly.

The width of the channel is significant in that the resilient finger must be capable of spanning the entire channel width, while still providing sufficient pressure to hold the business cards against the display face. With the finger attached at or near the top of the rear wall of the channel, and with the finger extending well over half-way into channel, it will be seen that the finger travel (with respect to its length) readily accommodates the channel width. It is also of significance that the finger is attached at the back of the channel, since it is automatically deflected out of the way upon insertion of a fresh stack or supplemental stack of business cards.

Figure 4:
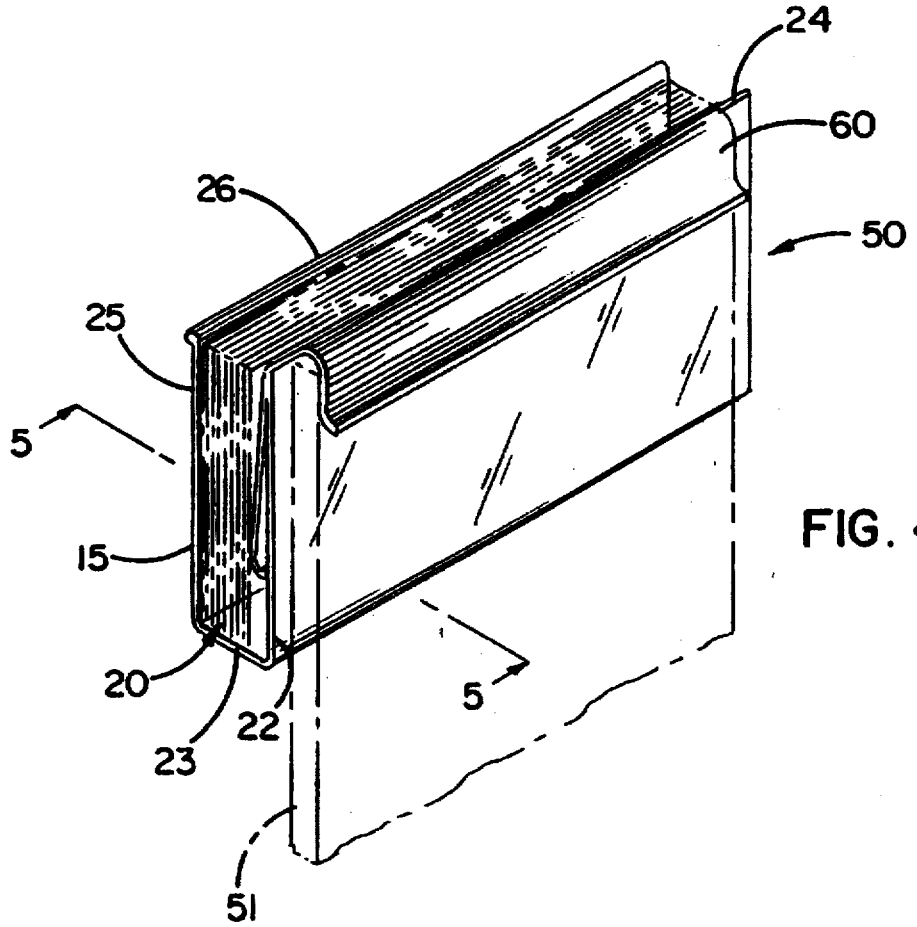
FIG. 4 is a perspective view of a preferred embodiment of a display holder adapted for hanging on a display containing other trade literature.
Figure 5:
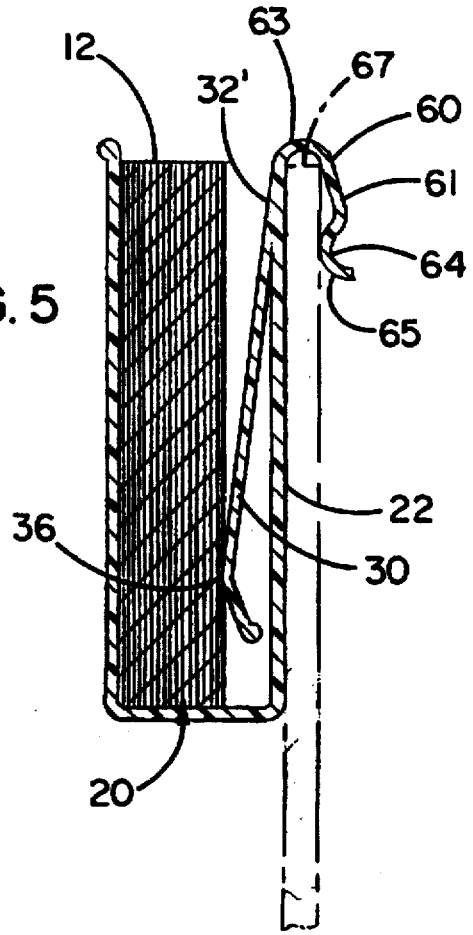
FIG. 5 is a sectional view taken generally along the line 5—5 of FIG. 4 showing a reasonably fully display holder.
Figure 6:
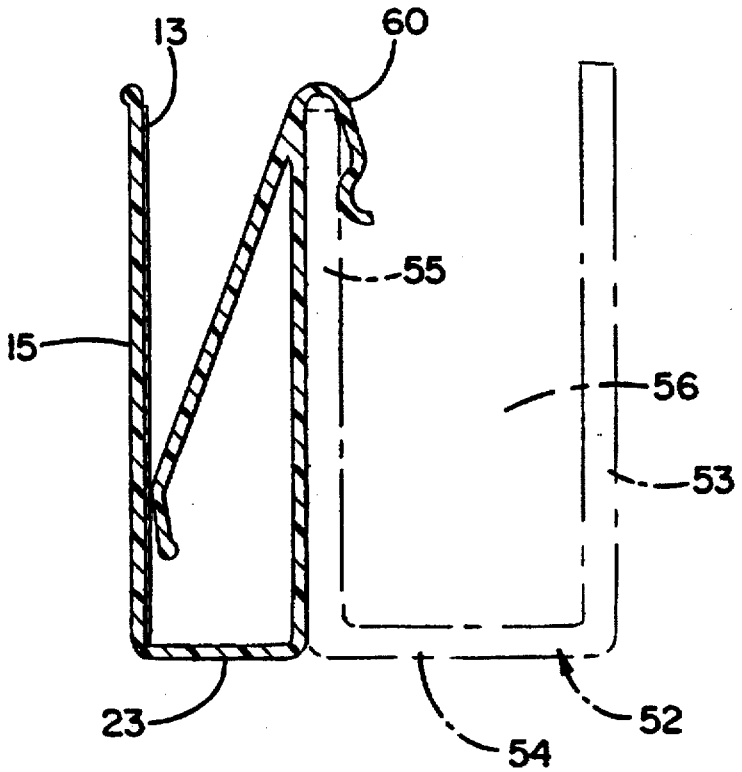
FIG. 6 is a view similar to FIG. 5 but showing only a single card in the display holder, and showing, in phantom lines, the display holder mounted to a literature display rack.

Turning then to FIGS. 4–6, there is shown an alternative form of display card holder 50 according to the invention, which in certain respects is the currently preferred form. The embodiment shown in FIGS. 4–6 is useful with literature display devices, shown in phantom at 51 and 52 in FIGS. 4 and 6, respectively. The phantom literature support 51 in FIG. 4 illustrates the front face of the display rack intended to hold product brochures. The phantom line device 52 in FIG. 6 illustrates such a rack having a back 53, a bottom 54, and a front 55 for holding display literature suggested at 56. The front face 55 has a horizontal edge 67 from which a business card display holder according to the invention can be suspended.

It will be seen in FIG. 4 that the business card holder there illustrated is the same as that in FIG. 1 in that it has a channel 20 formed by a front display face 15, a back member 22, and a supporting bottom 23. Sides 24, 25 are open as is the top 26. A spring finger 32' is attached near the top of back 22 and resiliently biased toward the display face. The primary difference between the display holder 10 of FIG. 1 and the display holder 50 of FIGS. 4–6 is the support means which supports the business card display holder. As best seen in FIGS. 5 and 6, the support means includes a resilient attachment means 60 which is formed of the same material and extruded with the channel member 20. The resilient attachment means 60 has a depending leg 61 which is located outside the channel 20 and biased toward the channel back 22 for gripping engagement with a surface 55, such as the supporting surface of the literature display stand. Thus, the depending leg 61 is connected to the back 22 at a curved resilient connecting section 63. A recurved end 64 provides a flared entry point 65, such that the business card display holder 50 is installed on a literature display rack or the like, simply by positioning the business card holder over the installation surface with the back 22 against the face of the supporting surface, then, by means of downward pressure, causing the leading edge 67 of the display surface to engage the outwardly curved section 65 to cam the resilient leg 61 outwardly. The business card display holder 50 is then manually pressed onto the literature display stand until the edge 67 engages the inside of the curved section 63 to provide a positive stop for installation.

It will also be noted from a comparison of FIGS. 5 and 6 that the display holder has a resilient finger 30 which is attached by hinge means 32' near the top of the back 22 and which extends below the center of the display face to engage the business cards along a line generally indicated at 36. The hinge 32' is of a slightly different form than the hinge 32 of the FIG. 1 embodiment. This slightly different form is occasioned in part by the simultaneous extrusion of the resilient supporting means 60 and the hinge. It will be seen, however, from the comparison of FIGS. 5 and 6, that the hinge section 32 has sufficient resilience to support a substantially full stack of business cards 12 in the loaded condition while having sufficient resilience to maintain the front card 13 biased against the display face 15 even when the supply is depleted to as few as one card as shown in FIG. 6.

What is claimed is:

1. A display holder for presenting a supply of business cards for individual distribution comprising a unitary member of transparent semi-rigid thermoplastic material formed in business card-sized lengths, the member in cross-section defining a channel having an open top, a display face, a supporting bottom, and a back;

the lengths having open sides, the display face being rectangular and about the size of a business card;

the channel including a unitary elongate finger connected to the channel back near its top, having a free edge extending toward the channel bottom and resiliently sprung toward the display face;

the elongate finger being sufficiently flexible to be deflected toward the channel back to allow insertion of a stack of business cards into the channel for support on the channel bottom and protection by the display face while the finger biases the stack of business cards against the display face; and the elongate finger having sufficient resilience to continue to bias the cards against the display face as cards are removed from the stack until the stack is depleted to as few as one card.

2. The display holder as set forth in claim 1 wherein the unitary member of transparent semi-rigid thermoplastic material is a unitary extrusion, and the lengths are segmented sections of said extrusion.

3. The display holder as set forth in claim 2 in which the channel bottom is of sufficient width to accommodate a stack of at least fifty cards, and the elongate finger has sufficient resilience to allow insertion of a stack of fifty cards, while retaining sufficient flexibility to bias only a single card against the display face.

4. The display holder as set forth in claim 2 wherein the display face has a length extending along the extrusion length of between three and four inches, a height, perpendicular to the length, of about two inches, and the channel has a width of about ½ inch or more.

5. The display holder as set forth in claim 2 further including a finger notch at the top of the display face for facilitating removal from the stack of single business cards.

6. The display holder as set forth in claim 2 further including a resilient attachment means extruded with and extending from the channel back, the attachment means having a depending leg outside the channel biased toward the channel back for gripping engagement with a surface from which the display holder is to be suspended.

7. The display holder as set forth in claim 2 further including foot means extruded with and attached near the bottom of the channel, the foot means extending forwardly and rearwardly of the channel, and terminating in a horizontal plane, to provide a base of sufficient width for supporting the display holder on a horizontal surface.

8. A method for making business card display holders adapted to support the top business card in a stack of business cards ranging from one to many business cards against a face of the display holder, while assuring that the top business card is supported against the face of the display holder, the method of comprising the steps of extruding in a single operation a three-sided channel having a display face, bottom and back, with an integral resilient finger attached to the back, extruding a hinge connecting the resilient finger to the back of the channel to provide the finger with sufficient resiliency to support a single card against the face or many cards in a stack without fatigue over many cycles, and cutting the so-formed extrusion into a plurality of individual business cards sized display units.

9. The method of claim 8 further including the step of extruding a supporting structure, along with the channel.

10. The method as set forth in claim 9 wherein the step of extruding a supporting structure includes extruding a pair of legs attached to the lower part of the channel and extending forwardly and rearwardly of the channel by a sufficient distance to support the display holder on a horizontal surface.

11. The method as set forth in claim 9 wherein the step of extruding a supporting structure includes extruding a resilient attachment means attached to the top of the channel back and having a depending leg outside the channel biased toward the channel back for gripping engagement with a surface from which the display holder is to be suspended.

12. The method as set forth in claim 8 wherein the step of extruding a hinge includes extruding such hinge to provide a guide surface for deflecting the hinge when a new or supplemental stack of cards is inserted into the channel.

* * * * *